US011313091B2

(12) United States Patent
Rodriguez

(10) Patent No.: US 11,313,091 B2
(45) Date of Patent: Apr. 26, 2022

(54) SNOW REMOVAL SYSTEM

(71) Applicant: Michael Rodriguez, Queens Village, NY (US)

(72) Inventor: Michael Rodriguez, Queens Village, NY (US)

( * ) Notice: Subject to any disclaimer, the term of this patent is extended or adjusted under 35 U.S.C. 154(b) by 0 days.

(21) Appl. No.: 16/670,059

(22) Filed: Oct. 31, 2019

(65) Prior Publication Data

US 2020/0141078 A1 May 7, 2020

Related U.S. Application Data

(60) Provisional application No. 62/754,150, filed on Nov. 1, 2018.

(51) Int. Cl.
*E01H 5/10* (2006.01)
*E01H 5/09* (2006.01)
*E01H 5/04* (2006.01)

(52) U.S. Cl.
CPC ..... *E01H 5/104* (2013.01); *E01H 5/045* (2013.01); *E01H 5/098* (2013.01)

(58) Field of Classification Search
CPC ..... E01H 5/104; E01H 5/045; E01H 5/098
See application file for complete search history.

(56) References Cited

U.S. PATENT DOCUMENTS 3,452,459 A * 7/1969 Campion ..... E01H 5/104 37/229
3,619,918 A * 11/1971 Morin ..... E01H 5/104 37/228
5,079,865 A 1/1992 Hutson
5,266,220 A 11/1993 Hammond et al.
6,353,212 B1 * 3/2002 Smith ..... E01H 5/104 219/533
7,958,656 B2 6/2011 Soderberg et al.
8,191,289 B2 * 6/2012 Raftery ..... E01H 5/12 37/271
9,032,649 B1 * 5/2015 Villanueva ..... E01H 5/045 37/227
9,695,562 B2 7/2017 Lukaj
10,208,442 B2 * 2/2019 Mast ..... E01H 5/045
2015/0252544 A1 * 9/2015 Houle ..... E01H 5/098 37/258
2015/0275447 A1 * 10/2015 Mondul ..... E01H 5/045 37/197
2015/0315758 A1 * 11/2015 Spievey ..... E01H 5/102 37/229

(Continued)

*Primary Examiner* — Jamie L McGowan
(74) *Attorney, Agent, or Firm* — Boudwin Intellectual Property; Daniel Boudwin

(57) ABSTRACT

A snow removal system. The snow removal system includes a housing having an inlet disposed on a front side thereof, wherein the inlet is in fluid communication with a first chamber. An auger is disposed transversely across the first chamber, wherein the auger is operably connected to a motor within the housing. The auger rotates about a longitudinal axis thereof to mash snow and transport the mashed snow into a second chamber when the motor is actuated. The second chamber includes a primary heating element therein, the heating element designed to heat snow within the second chamber to produce steam. An outlet is disposed through a sidewall of the second chamber, wherein the outlet can emit steam from the second chamber.

18 Claims, 4 Drawing Sheets

(56) References Cited

U.S. PATENT DOCUMENTS

| | | | | |
|---|---|---|---|---|
| 2016/0002871 | A1* | 1/2016 | Asgari | E01H 5/104<br>37/197 |
| 2016/0053452 | A1 | 2/2016 | Treglown | |
| 2016/0356010 | A1* | 12/2016 | Wilkinson | E01H 5/106 |

* cited by examiner

SNOW REMOVAL SYSTEM

CROSS REFERENCE TO RELATED APPLICATIONS

This application claims the benefit of U.S. Provisional Application No. 62/754,150 filed on Nov. 1, 2018. The above identified patent application is herein incorporated by reference in its entirety to provide continuity of disclosure.

BACKGROUND OF THE INVENTION

The present invention relates to snow removal systems. More particularly, the present invention pertains to a snow removal system that collects and heats snow from a ground surface to emit steam.

Many individuals are forced to clear sidewalks, driveways, and other walkways after heavy snow accumulation to allow pedestrians and vehicles to traverse these areas. Without such snow removal, pedestrians may slip and fall on snow or ice, leading to severe injury. Similarly, vehicles may lose traction on heavily snow-covered roads, leading to significant vehicular accidents, potentially leading to injuries or significant damage to vehicles and property.

Typically, individuals rely on shovels, snow blowers, and snowplows to displace snow from the desired area. However, these methods still require the user to place the snow removed from the desired area in another location, which increases the length of time the snow remains on the ground. Additionally, displaced snow may fall back onto the cleared surfaces, requiring additional effort and time to displace again. Oftentimes, displaced snow can also wind up being placed onto a vehicle or other surface that must then be cleared, resulting in additional work to sufficiently clear an area of snow accumulation. Therefore, a device that can vaporize snow rather than displacing it is desired.

In light of the devices disclosed in the known art, it is submitted that the present invention substantially diverges in design elements from the known art and consequently it is clear that there is a need in the art for an improvement to existing snow removal systems. In this regard, the instant invention substantially fulfills these needs.

SUMMARY OF THE INVENTION

In view of the foregoing disadvantages inherent in the known types of snow removal systems now present in the known art, the present invention provides a snow removal system wherein the same can be utilized for providing convenience for the user when removing snow from a ground surface via evaporation thereof to prevent displacement of snow onto a surrounding surface.

The present system comprises a housing having an inlet disposed on a front side thereof, wherein the inlet is in fluid communication with a first chamber. An auger is disposed transversely across the first chamber, wherein the auger is operably connected to a motor disposed within the housing. The auger is configured to rotate about a longitudinal axis thereof to mash snow and transport the mashed snow into a second chamber when the motor is actuated. The second chamber includes a primary heating element therein, the heating element configured to heat snow within the second chamber to produce steam. An outlet is disposed through a sidewall of the second chamber, wherein the outlet is configured to emit steam from the second chamber.

In some embodiments, the housing further comprises a frame affixed to a rear side of the housing, wherein the frame comprises a pair of handles on opposing lateral sides of the frame. A control panel extends between the opposing lateral sides, wherein the control panel includes an auger control thereon configured to adjust the rate of rotation of the auger. In another embodiment, a bracket is disposed on the rear side of the housing, the bracket configured to removably secure the housing to a vehicle. In this way, the snow removal system is contemplated to be used with an individual directing the housing via the frame, or a driver directing the housing via the vehicle.

In other embodiments, a pair of wheels are disposed on a lower end of the housing along a rear side thereof, wherein the pair of wheels are operably connected to a drive motor within the housing. In yet another embodiment, a pair of skids are disposed on the lower end of the housing along the front side. In this way, the housing is configured to traverse a snow-covered surface while ensuring a minimal elevation of the front side thereof to ensure maximal snow removal.

In some embodiments, the first chamber comprises an arcuate rear wall extending between a pair of lateral panels. In another embodiment, a secondary heating element extends across the first chamber. In other such embodiments, the secondary heating element is parallel to the auger. In this way, snow is partially melted upon entry within the first chamber, reducing the snow's resistance to mashing forces imparted by the auger.

In some embodiments, a temperature gauge is disposed on an upper side of the housing, wherein the temperature gauge is configured to display a current temperature within the second chamber. In another embodiment, the housing further comprises a third chamber having a tertiary heating element therein, the third chamber in fluid communication with the second chamber. In this way, the user is apprised of the current temperature within the second chamber, and a gradual heating of the snow throughout the housing can be achieved.

In another embodiment, the outlet comprises an arcuate upper wall, such that the outlet is configured to direct steam towards a lower side of the housing. In other embodiments, a rear vent is disposed on a rear side of the housing, wherein the rear vent is configured to direct emitted steam towards the control panel. In this way, the steam is directed away from the housing and towards a desired surface. Alternatively, the rear vent can be used to ensure that the user is heated by the steam.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
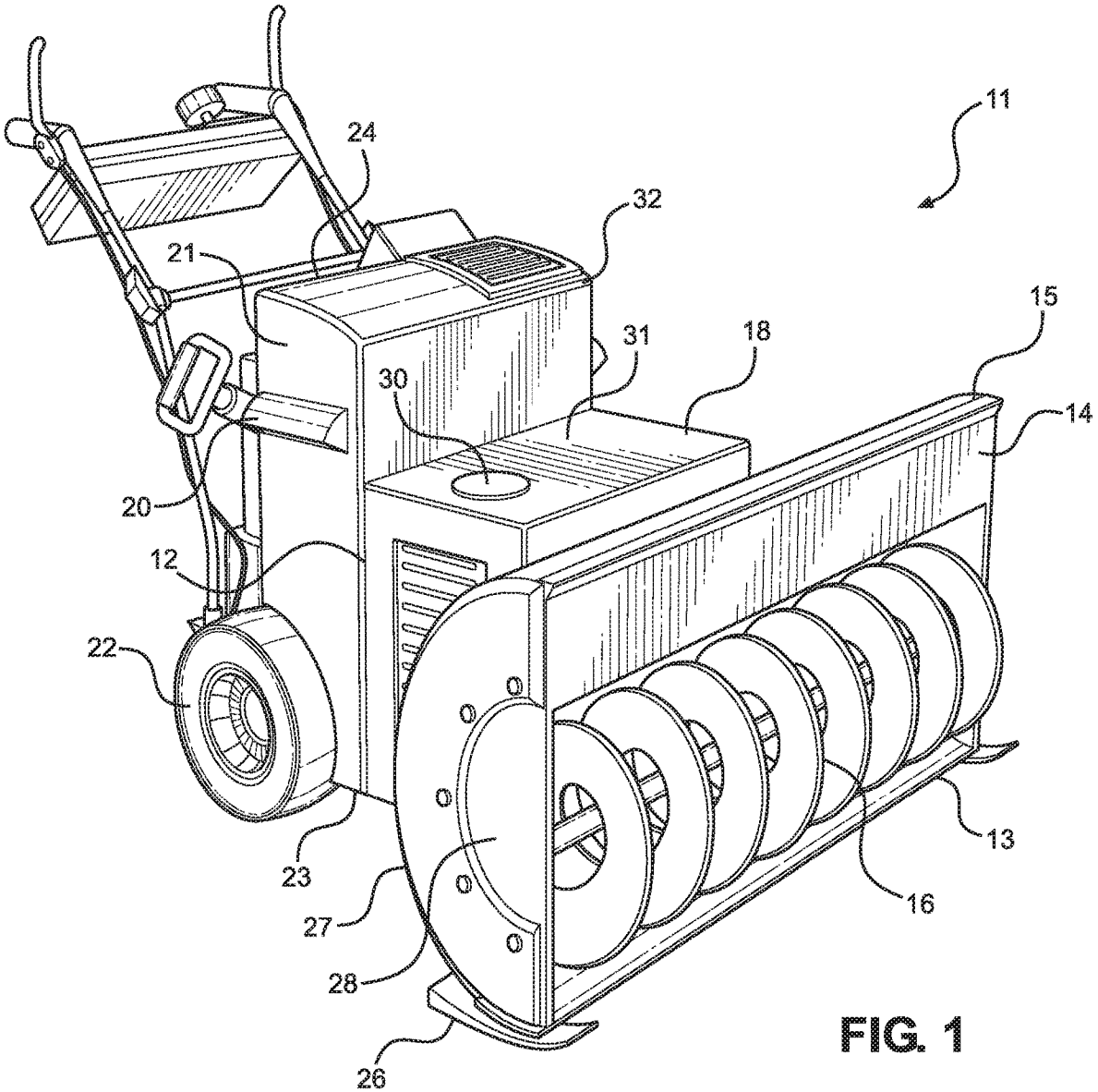
FIG. 1 shows a perspective view of an embodiment of the snow removal system.

Reference is made herein to the attached drawings. Like reference numerals are used throughout the drawings to depict like or similar elements of the snow removal system. The figures are intended for representative purposes only and should not be considered to be limiting in any respect.

Referring now to FIG. 1, there is shown a perspective view of an embodiment of the snow removal system. The snow removal system 11 comprises a housing 12 having a front side 14 disposed opposite a rear side 24. A pair of sidewalk 21 extend between the front side 14 and the rear side 24, thereby defining a plurality of chambers within the housing 12. The plurality of chambers includes a first chamber 15 defined at the front side 14, wherein the first chamber 15 defines an inlet 13. A second chamber 18 is in fluid communication with the first chamber 15, such that material, such as snow, captured by the first chamber 15 through the inlet 13 is transported therethrough and into the second chamber 18. In the shown embodiment, the housing 12 further comprises a third chamber 32 in fluid communication with the second chamber 18. In the illustrated embodiment, the first, second, and third chambers 15, 18, 32 each comprise different and increasing volumes to account for phase changes induced in the snow collected by the first chamber 15 altering the volume of the snow.

Figure 2:
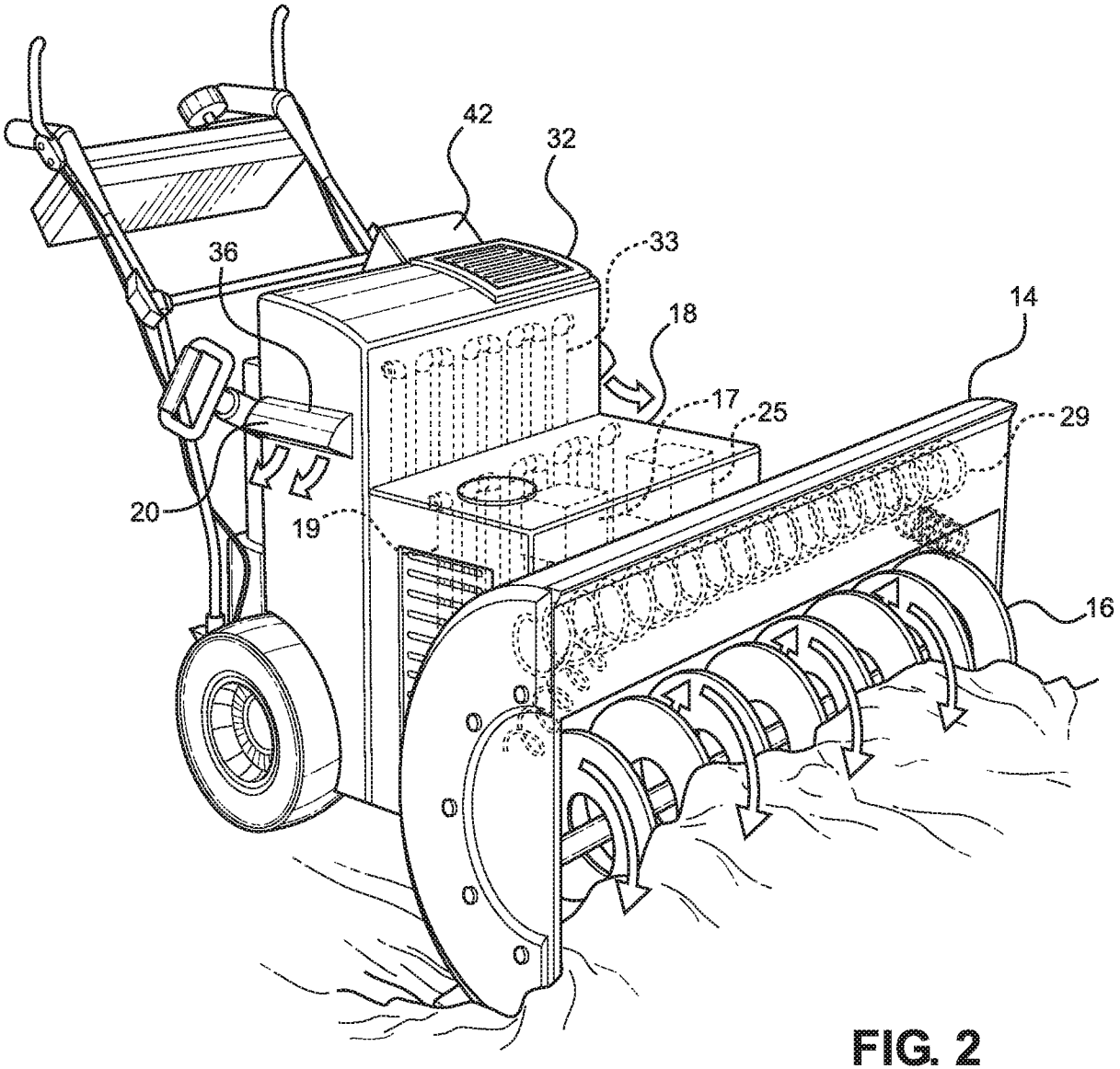
FIG. 2 shows a semi-transparent view of an embodiment of the snow removal system.

In the illustrated embodiment, the first chamber 15 comprises a width greater than that of the remainder of the housing 12, such that the inlet 13 defined thereby is maximized to allow the snow removal system 11 to collect snow therethrough. An auger 16 having a helically spiraling blade about a longitudinal axis thereof extends between opposing lateral panels 28 of the first chamber 15, such that the auger 16 extends perpendicularly relative to the sidewalls 21. In the shown embodiment, the first chamber 15 further comprises an arcuate rear wall 27 configured to encompass the auger 16 therein. The auger 16 is configured to rotate about a longitudinal axis thereof, thereby transporting snow collected through the inlet 13 towards the second chamber 18. The auger 16 is operably connected to an auger motor (as shown in FIG. 2, 17), wherein the auger motor is configured to provide the driving force to the auger 16 to produce the desired rotation when the auger motor is actuated. Additionally, the helically spiraling blade of the auger 16 breaks up the collected snow as it rotates to allow for easier transport, as well as increasing the surface area of the snow to promote rapid heat transfer.

The housing 12 further comprises at least one outlet 20 thereon, wherein the illustrated embodiment, an outlet 20 is disposed on each of the opposing sidewalls 21, as well as an additional rear outlet (as shown in FIG. 2, 42) disposed on the rear side 24. The outlets 20 and the rear outlet 24 are each in fluid communication with the interior of the respective chambers that each outlet 20 is disposed on, such that steam within each chamber is exhausted by each outlet 20. Additionally, in the shown embodiment, a temperature gauge 30 is disposed on an upper side 31 of the housing 12, wherein the temperature gauge 30 is configured to display the temperature within the housing 12 at the location of the temperature gauge 30. In some embodiments, a temperature gauge 30 is disposed on the upper surface 31 of each of the plurality of chambers. In this way, the user can readily determine the temperature of each chamber of the housing 12.

In the shown embodiment, a pair of wheels 22 are disposed on a lower end 23 of the housing 12, wherein the pair of wheels 22 are configured to drive the housing 12 in a desired direction. In some embodiments, a drive motor (as shown in FIG. 2, 25) is operably connected to the pair of wheels 22, such that the drive motor provides rotational forces thereto, allowing the pair of wheels 22 to rotate to drive the housing 12 in a desired direction. In the shown embodiment, a pair of skids 26 are disposed on the lower end 23 of the front side 14, wherein the pair of skids 26 are configured to slide across a surface when the pair of wheels 22 drive the housing 12. In this way, a lower edge of the inlet 13 of the first chamber 15 is maintained at a lower height than the lower end 23 of the housing 12, thereby allowing the inlet 13 to capture a maximal amount of snow on the ground surface. Additionally, the shown embodiment allows the snow removal device 11 to be utilized in periods of minimal snowfall, such that ground surfaces can be maintained in a clear state to prevent the development of ice thereon. In some embodiments, a second pair of wheels are disposed on the lower end 23 of the front side 14, such that frictional resistances against the lower end 23 are reduced compared to the embodiment having the pair of skids 26. This embodiment, however, also raises the front side 14 relative to the ground surface, reducing the among of snow captured by the inlet 13.

Referring now to FIG. 2, there is shown a semi-transparent view of an embodiment of the snow removal system. In the shown embodiment, a plurality of heating elements are disposed within the housing, wherein a separate heating element is disposed within each of the first, second, and third chambers 15, 18, 32. Each of the plurality of heating elements can comprise a variety of heating elements known in the art, however, for the purposes of brevity, the primary heating elements shown include shell and tube heat exchangers and resistive heating coils. In the illustrated embodiment, a primary heating element 19 is disposed within the second chamber 18, wherein the primary heating element 19 is configured to heat the snow within the second chamber 18 to produce steam. The produced steam can then be vented through an outlet 20 disposed on the sidewall of the second chamber 18. In the shown embodiment, a secondary heating element 29 extends across a length of the first chamber 15 parallel to the auger 16. The secondary heating element 29 is configured to heat the snow collected within the first chamber 15 to allow the auger 16 to more readily break up incoming snow. In this way, particularly frozen snow, such as after a period of melting and refreezing, can be readily removed by the snow removal system. Furthermore, in the shown embodiment, the secondary heating element 29 branches into a pair of secondary coils at opposing ends thereof, wherein the secondary coils are angled towards the auger 16. In this embodiment, the pair of secondary coils are in closer proximity to the auger 16 than the secondary heating element 29, thereby increasing efficiency of heat transfer therebetween. In some embodiments, a tertiary heating element 33 is disposed within the third chamber 32. In this way, the snow collected within the housing can be gradually heated across a parallel multistage heating process through each of the plurality of chambers, such that the expansion of the heated snow into steam does not exceed the rate of exhaust through the outlet 20, thereby preventing pressure buildup therein. In some embodiments, each of the plurality of heating elements can be independently heated to a separate desired temperature, such that the snow is gradually heated to prevent sudden rapid expansion from significant temperature variation.

In the illustrated embodiment, the auger motor 17 and the drive motor 25 are disposed within the housing and operably connected to the auger 16 and the pair of wheels as previously described. In some embodiments, each of the motors 17, 25 are disposed within heat resistant compartments within the housing, such that the elevated temperatures within each of the first, second, and third chambers 15, 18, 32 do not negatively impact the operation of each of the motors 17, 25. In the shown embodiment, the motors 17, 25 are disposed within the second chamber 18, however, it is contemplated that each motor 17, 25 can be placed anywhere within the housing, commensurate with manufacturing needs and limitations.

In the illustrated embodiment, the outlets 20 are disposed on opposing side walls of the housing and each comprise an arcuate upper wall 36. The arcuate upper wall 36 is configured to direct expelled steam downwards away from the housing and towards the ground surface being cleared. In this way, the steam is guided away from any objects, such as vehicles or the like, in the immediately surrounding area, thereby preventing any damage caused by contact therewith. Additionally, in the shown embodiment, the snow removal system further comprises a rear vent 42 facing in an opposite direction of the inlet. The rear vent 42 can comprise a cowling about a perimeter thereof, the cowling configured to guide exhausted steam in a desired direction. In the illustrated embodiment, the cowling is canted upwards relative to the lower end of the housing, such that the exhausted steam is directed in the general direction of the user. In this way, as the heated steam dissipates, the air in the vicinity of the user can be warmed slightly, thereby minimizing discomfort of the user in conditions of extreme cold.

Figure 3A:
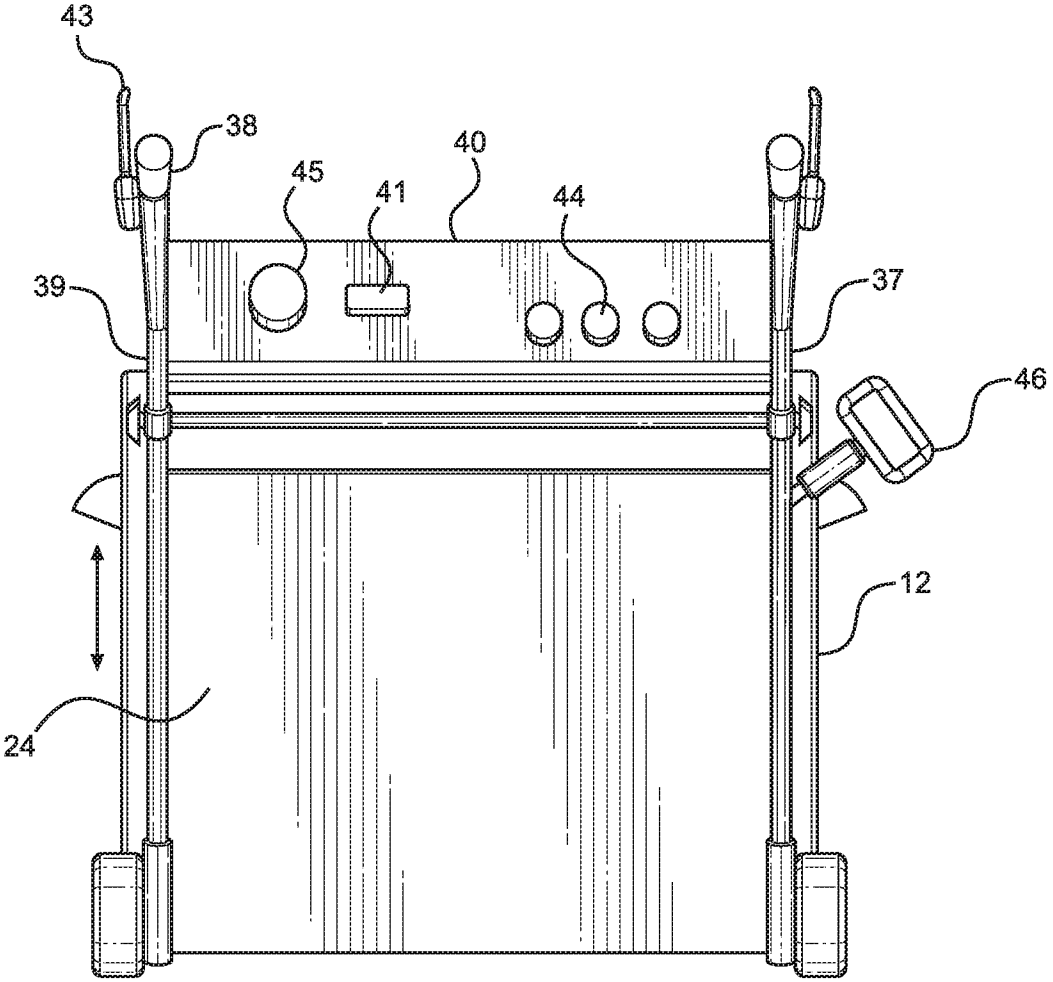
FIG. 3A shows a rear view of the frame of an embodiment of the snow removal system.

Referring now to FIG. 3A, there is shown a rear view of the frame of an embodiment of the snow removal system. In the illustrated embodiment, the snow removal system further comprises a frame 37 affixed to the rear side 24 of the housing 12. The frame 37 comprises a pair of opposing lateral sides 39, each terminating in a handle 38. In this way, a user can grasp the handles 38 to direct the snow removal system in a desired direction. In some embodiments, the pair of opposing lateral sides 39 are telescopically adjustable, such that the user can adjust the height of the frame 37 to better conform to the height of the user. In the shown embodiment, a starter handle 46 is disposed on the housing 12 and is operably connected to each of the auger and drive motors, such that the user can engage each of the motors via the starter handle 46.

In the illustrated embodiment, a control panel 40 extends between the pair of opposing lateral sides 39 of the frame 37. The control panel 40 includes a plurality of controls thereon, wherein each of the controls is configured to operate a component of the snow removal system. In the shown embodiment, the plurality of controls includes an auger control 41, several temperature controls 44, and an emergency stop button 45. The auger control 41 is operably connected to the auger via the auger motor, such that when the auger control 41 is actuated, the auger is rotated by the auger motor. In the shown embodiment, the temperature controls 44 each correspond to a separate heating element, allowing the user to individually control the temperature of each heating element. In this way, the user is ensured precise heating control of the snow. Finally, the emergency stop button 45 is configured to immediately cease operation of the auger and drive motors. In this way, should the snow removal system encounter a dangerous obstacle or situation, the operation of the snow removal system can be immediately halted to prevent further damage or destruction of property. Alternate controls are also contemplated, but not shown, wherein the alternate controls include an auger rotation control configured to selectively adjust the rate of rotation of the auger to increase or decrease the rate at which snow is transferred to the second chamber, as well as separate activation controls for each individual heating element, such that the user can determine when additional heating elements are required to appropriately clear or melt collected snow. In this way, the user can minimize energy usage of the device, saving on fuel costs or charging time for gasoline and electric embodiments, respectively.

Additionally, a throttle 43 can be positioned on the control panel 40, however, in the shown embodiment, the throttle 43 is pivotally affixed on the frame 37 adjacent to the handles 38. In this embodiment, as the throttle 43 is lowered towards the handle 38, power to the drive motor is increased, providing a driving force to the pair of wheels. In this way, the operation of the throttle 43 requires the user to be continually grasping the handles 38, such that the throttle 43 operates as a dead man's switch, thereby maximizing safety and ensuring that the snow removal system is in constant control by the user.

Figure 3B:
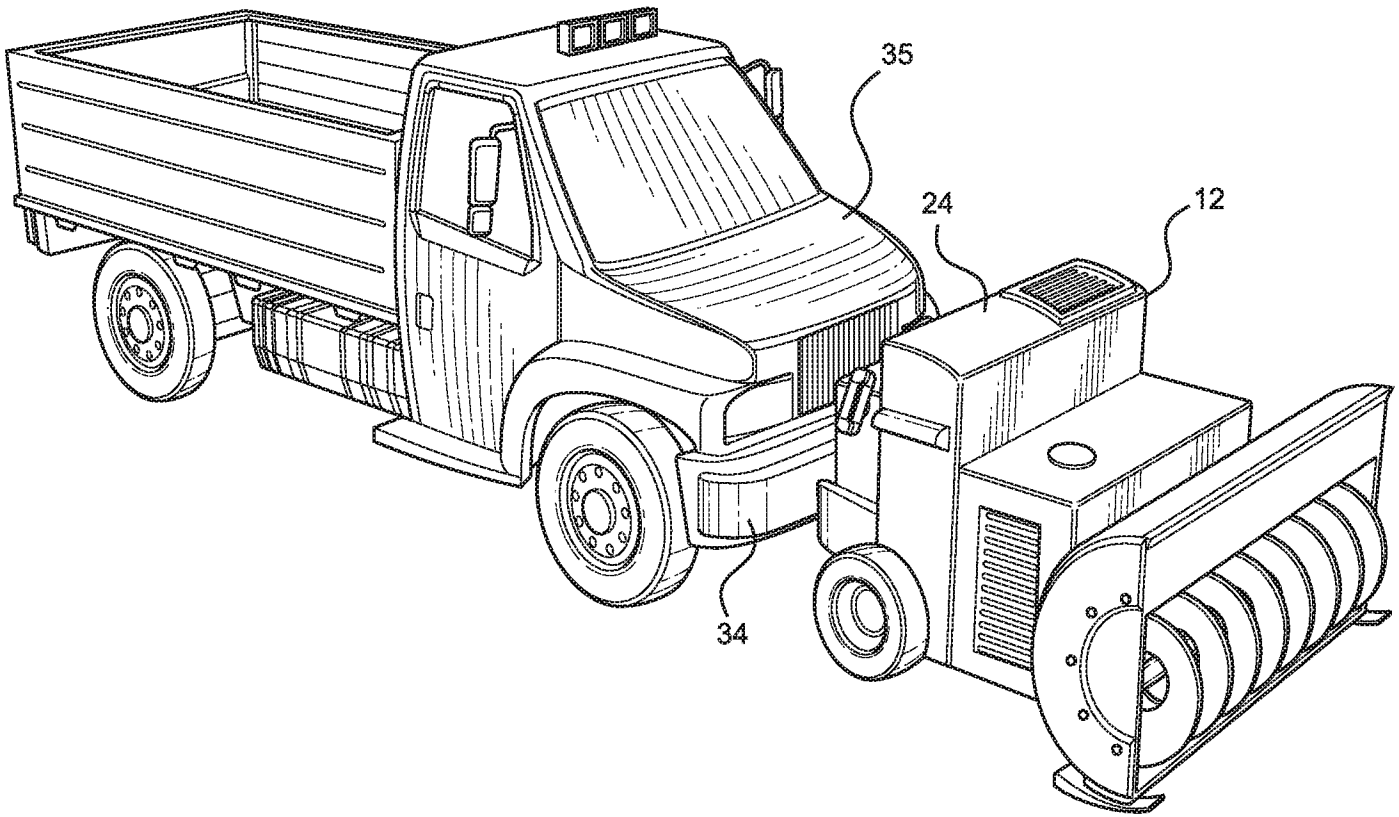
FIG. 3B shows a perspective view of the bracket of an embodiment of the snow removal system secured to a vehicle.

Referring now to FIG. 3B, there is shown a perspective view of the bracket of an embodiment of the snow removal system secured to a vehicle. In the illustrated embodiment, the snow oval system further comprises a bracket 34 affixed to the rear side 24 of the housing 12. The bracket 34 is configured to removably secure the housing 12 to a vehicle 35 to allow the user to drive the snow removal system along a street to clear it of snow. In the shown embodiment, the bracket 34 comprises a curved member removably securable to a bumper of the vehicle 35 via at least one fastener, however alternate securement means are also contemplated. The curved nature of the bracket 34 allows the bracket 34 to conform to the shape of traditional bumpers, such that the bracket 34 rests flush against the bumper along an entire length thereof.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A snow removal system, comprising:

a housing having an inlet disposed on a front side thereof;

wherein the inlet is in fluid communication with a first chamber;

an auger disposed transversely across the first chamber, wherein the auger is operably connected to an auger motor disposed within the housing;

wherein the auger is configured to rotate about a longitudinal axis thereof to mash snow and transport the mashed snow into a second chamber when the auger motor is actuated;

wherein the second chamber includes a primary heating element therein, the primary heating element configured to heat snow within the second chamber to produce steam;

a secondary heating element disposed within and extending across the first chamber;

wherein the secondary heating element further comprises a pair of secondary coils extending from opposing ends of the secondary heating element, wherein the pair of secondary heating coils are angled towards the auger;

an outlet disposed through a sidewall of the second chamber, the outlet configured to emit steam from the second chamber.

2. The snow removal system of claim 1, further comprising a pair of wheels disposed on a lower end of the housing along a rear side thereof, wherein the pair of wheels are operably connected to a drive motor disposed within the housing.

3. The snow removal system of claim 2, further comprising a pair of skids disposed on the lower end of the housing along the front side thereof.

4. The snow removal system of claim 1, wherein the first chamber comprises an arcuate rear wall extending between the pair of lateral panels.

5. The snow removal system of claim 1, wherein the secondary heating element is parallel to the auger.

6. The snow removal system of claim 1, further comprising a temperature gauge on an upper side of the housing, wherein the temperature gauge is configured to display a current temperature within the second chamber.

7. The snow removal system of claim 1, wherein the housing further comprises a third chamber having a tertiary heating element therein, the third chamber in fluid communication with the second chamber.

8. The snow removal system of claim 1, further comprising a bracket disposed on a rear side of the housing, wherein the bracket is configured to removably secure the housing to a vehicle.

9. The snow removal system of claim 1, wherein the outlet comprises an arcuate upper wall, such that the outlet is configured to direct steam towards a lower end of the housing.

10. A snow removal system, comprising:

a housing having an inlet disposed on a front side thereof;

wherein the inlet is in fluid communication with a first chamber;

an auger disposed transversely across the first chamber, wherein the auger is operably connected to an auger motor disposed within the housing;

wherein the auger is configured to rotate about a longitudinal axis thereof to mash snow and transport the mashed snow into a second chamber when the auger motor is actuated;

wherein the second chamber includes a primary heating element therein, the primary heating element configured to heat snow within the second chamber to produce steam;

a secondary heating element disposed within and extending across the first chamber;

wherein the secondary heating element further comprises a pair of secondary coils extending from opposing ends of the secondary heating element, wherein the pair of secondary heating coils are angled towards the auger;

an outlet disposed through a sidewall of the second chamber, the outlet configured to emit steam from the second chamber;

a frame affixed to a rear side of the housing, wherein the frame comprises a pair of handles on opposing lateral sides of the frame;

a control panel extending between the opposing lateral sides, the control panel comprising an auger control thereon configured to adjust a rate of rotation of the auger.

11. The snow removal system of claim 10, further comprising a pair of wheels disposed on a lower end of the housing along a rear side thereof, wherein the pair of wheels are operably connected to a drive motor disposed within the housing.

12. The snow removal system of claim 11, further comprising a pair of skids disposed on the lower end of the housing along the front side thereof.

13. The snow removal system of claim 10, wherein the first chamber comprises an arcuate rear wall extending between the pair of lateral panels.

14. The snow removal system of claim 10, wherein the secondary heating element is parallel to the auger.

15. The snow removal system of claim 10, further comprising a temperature gauge on an upper side of the housing, wherein the temperature gauge is configured to display a current temperature within the second chamber.

16. The snow removal system of claim 10, wherein the housing further comprises a third chamber having a tertiary heating element therein, the third chamber in fluid communication with the second chamber.

17. The snow removal system of claim 10, wherein the outlet comprises an arcuate upper wall, such that the outlet is configured to direct steam towards a lower end of the housing.

18. The snow removal system of claim 10, further comprising a rear outlet through a rear side of the housing, wherein the rear outlet is configured to direct emitted steam towards the control panel.

* * * * *